United States Patent [19]

Eckel

[11] 4,084,453

[45] Apr. 18, 1978

[54] POWER TONGS

[75] Inventor: Emery Lee Eckel, Odessa, Tex.

[73] Assignee: Eckel Manufacturing Co., Inc., Odessa, Tex.

[21] Appl. No.: 671,959

[22] Filed: Mar. 30, 1976

[51] Int. Cl.[2] ..... B25B 17/00

[52] U.S. Cl. ..... 81/57.18

[58] Field of Search ..... 81/57.18

[56] References Cited

U.S. PATENT DOCUMENTS

| | | | |
|---|---|---|---|
| 2,879,680 | 3/1959 | Beeman et al. | 81/57.18 |
| 3,180,186 | 4/1965 | Catland | 81/57.18 |
| 3,261,241 | 7/1966 | Catland | 81/57.18 |
| 3,776,320 | 12/1973 | Brown | 81/57.18 |

*Primary Examiner*—James L. Jones, Jr.
*Attorney, Agent, or Firm*—Fleit & Jacobson

[57] ABSTRACT

A power tong includes a frame and a pipe-gripping mechanism associated with a throat at one end of the frame. Power is transmitted to the pipe-gripping mechanism from a power unit through a drive train. The pipe-gripping mechanism cooperates with the throat to receive a pipe section to be rotated and includes a partial ring rotatably mounted within the frame and having an opening which may be aligned with the throat. The ring may be rotated in either direction by the power unit. Mounted on the tong is a die carrier which is rotatable relative to the ring. Link members are pivotally mounted on the die carrier and include dies positioned to grip the external surface of the pipe section. The link members are arranged to cooperate with specially designed cam surfaces on the ring so that, when the ring is rotated relative to the die carrier, the dies are moved into engagement with the pipe section. After the movable dies have engaged the pipe section further relative movement between the ring and the die carrier is prevented and the pipe section is therefore rotated to make up or break apart the threaded joint of pipe.

9 Claims, 3 Drawing Figures

POWER TONGS

BACKGROUND OF THE INVENTION

The present invention relates to power tongs of the type commonly used in oil fields for making up and breaking apart threaded connections between drill pipes, casing, tubing, and the like.

It is frequently necessary in oil field operations to connect or disconnect joints of pipe which are threadedly connected together. Strings of drill pipes, for example, comprise a series of pipe sections joined together at their ends. Power tongs are employed for making up and breaking apart these connections and are used to rotate the pipes relative to each other. A typical power tong includes a mechanism for gripping the external surface of a pipe section and then rotating the pipe section while the pipe section to which it is connected is held stationary or rotated in the opposite direction.

A variety of power tong constructions have been developed for accomplishing this result. U.S. Pat. No. 2,879,680 to Beeman et al, which is commonly assigned with the present application, is illustrative of one type of tong construction. Although devices of this type have proved satisfactory for most oil field operations, extensive use and experimentation has shown that improvements are needed, particularly with respect to the pipe-gripping mechanism and the means for urging the mechanism into contact with the pipe.

Accordingly, an object of the present invention is to provide a power tong for making up and breaking apart joints of drill pipe, casing, tubing, and the like having an improved pipe-gripping mechanism.

Another object of the invention is to provide a power tong having improved means for actuating the pipe-gripping mechanism in order to better grip and rotate the sections of pipe relative to each other.

Yet another object of the invention is to provide a power tong which has an improved camming arrangement for actuating the pipe-gripping mechanism.

These together with other objects and advantages of the invention will become more apparent upon reading the undergoing specification and claims.

SUMMARY OF THE INVENTION

A power tong is provided in accordance with the present invention which includes a frame having a pipe-gripping mechanism associated with a throat defined at one end of the frame. Power is transmitted to the pipe-gripping mechanism from a power unit through a drive train.

The pipe-gripping mechanism cooperates with the throat to receive a pipe section to be rotated. The pipe-gripping mechanism includes a partial ring rotatably mounted within the frame and having an opening which may be aligned with the throat so that the pipe section may be positioned within the ring. This ring may be rotated in either the clockwise or counterclockwise direction by the power unit and drive train which cooperates with gear teeth rigidly fixed to the ring.

A die carrier is mounted on the tong and is rotatable relative to the ring. The die carrier includes link members which are pivotally mounted on the carrier and have dies positioned to grip the external surface of the pipe section which is to be rotated. The link members are arranged to cooperate with specially designed cam surfaces on the ring so that, when the ring is rotated relative to the die carrier, the dies are moved into engagement with the pipe section. After the movable dies have engaged the pipe section, further relative movement between the ring and the die carrier is prevented and the pipe section is therefore rotated to make up or break apart a threaded joint of pipe.

DESCRIPTION OF THE PREFERRED EMBODIMENTS

Figure 1:
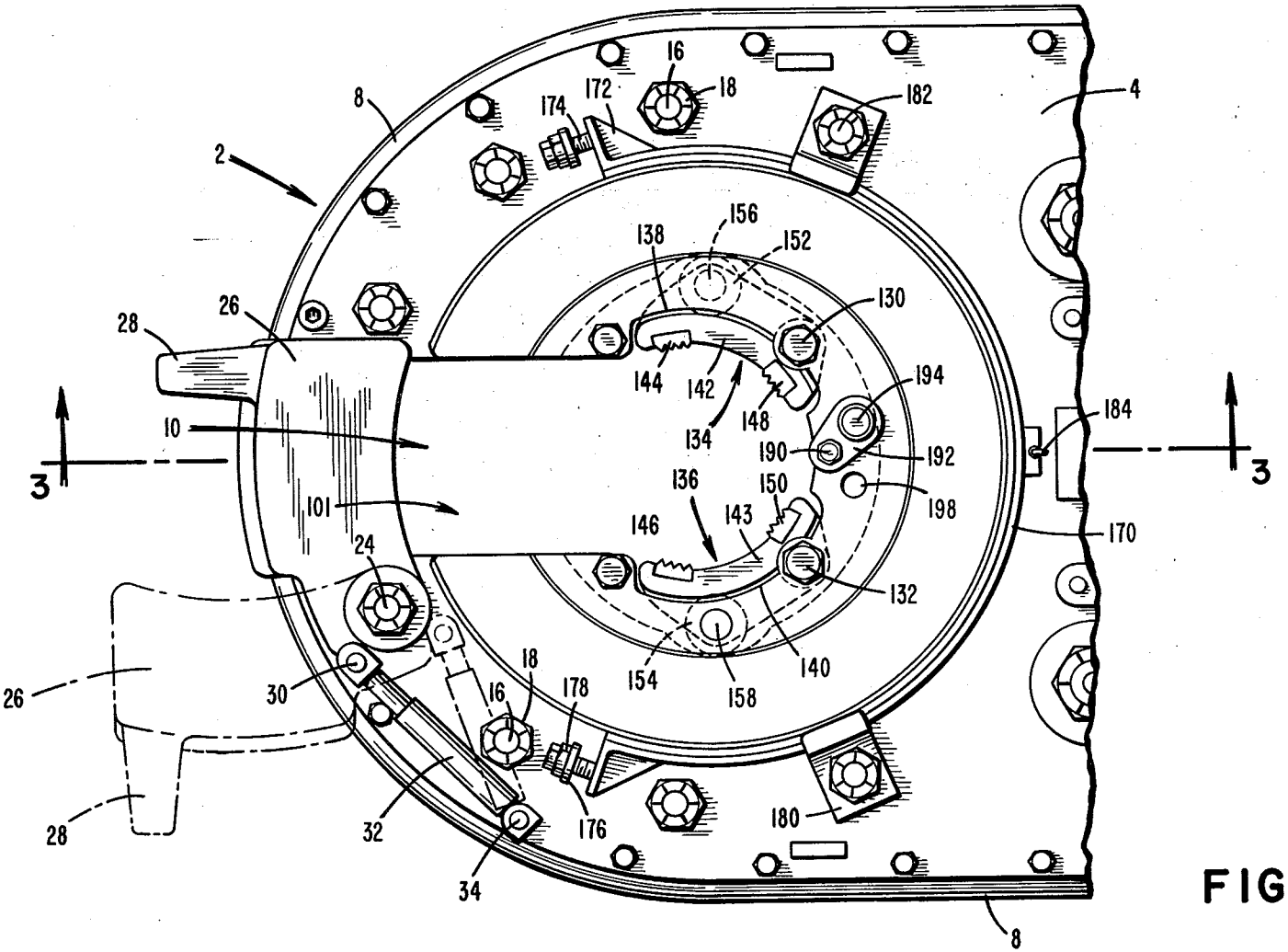
FIG. 1 is a plan view of the front portion of a power tong according to the invention.

Referring now in detail to the drawings, the frame 2 of the power tong includes an upper plate 4 and a lower plate 6 spaced apart and bolted to the sidewalls 8. The frame 2 has an arcuate front portion defining a throat 10 for receiving a pipe section such as a section of drill pipe, casing, tubing or the like. Mounted around the inner periphery of the front portion of the frame 2 are a plurality of rollers 12 and 14. The rollers 12 are mounted on the bottom side of the upper plate 4 and the rollers 14 on the top side of the lower plate 6. The rollers 12 and 14 are mounted in suitable bearings on a common shaft 16 which is threaded at both ends and which receives retaining nuts 18. Rollers 12 and 14 are retained in position by shoulders 20 and 22, respectively, of shaft 16.

Pivotally mounted to the frame 2 adjacent the throat 10 by means of a hinge pin 24 is a door 26 which may be opened by means of handle 28 to allow a section of pipe to be placed in the throat 10 of the power tong. Pivotally attached at 30 to the door 26 is one end of a spring-loaded piston assembly 32. The other end of the piston assembly 32 is pivotally attached at 34 to the frame in order to retain the door in the open or closed position. The door and piston assembly are shown in the closed position in solid lines and in the open position in phantom lines. Optionally, the door 26 may include a latch mechanism (not shown) which cooperates with a corresponding hook (not shown) mounted on the frame 2 so that the door 26 can be securely locked in place after a pipe section has been placed into the throat 10.

The pipe-gripping mechanism includes a partial ring 40 which comprises a rotary gear mounted for rotation within the frame 2 and has an opening 42 which is adapted to align with the throat 10 of the frame. The ring 40 is guided on its outer periphery and retained within the frame 2 by the rollers 12 and 14. More particularly, the ring 40 includes a projection 44 which extends around the outer circumference of the ring and defines upper and lower shoulders 46 and 48, respectively, which abut against rollers 12 and 14, respectively. Rigidly secured to the outer periphery of the projection 44 of the ring 40 are gear teeth 50.

Figure 2:
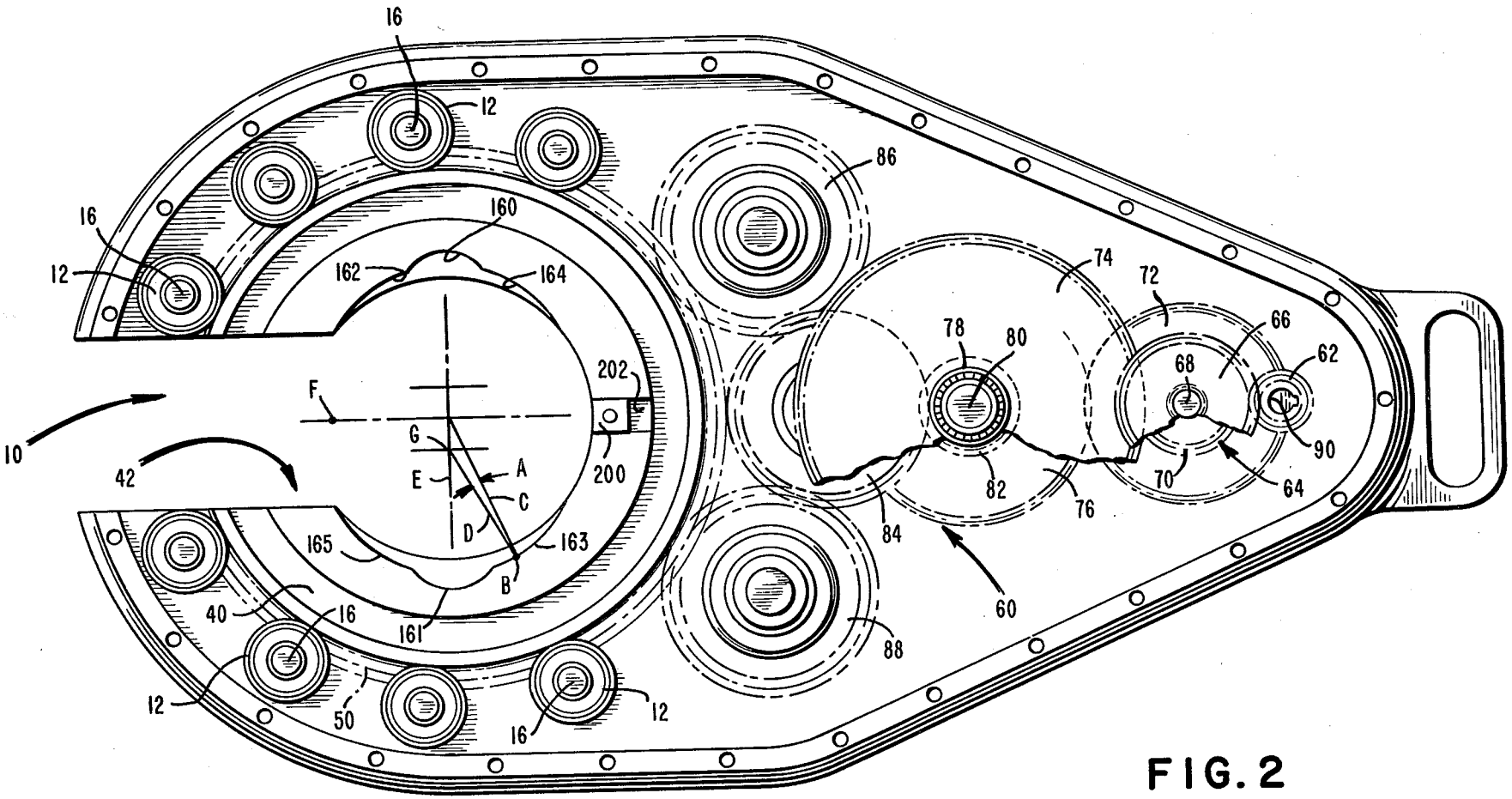
FIG. 2 is a plan view of the entire power tong of FIG. 1 with the top plate of the frame, the door and the die carrier removed.
Figure 3:
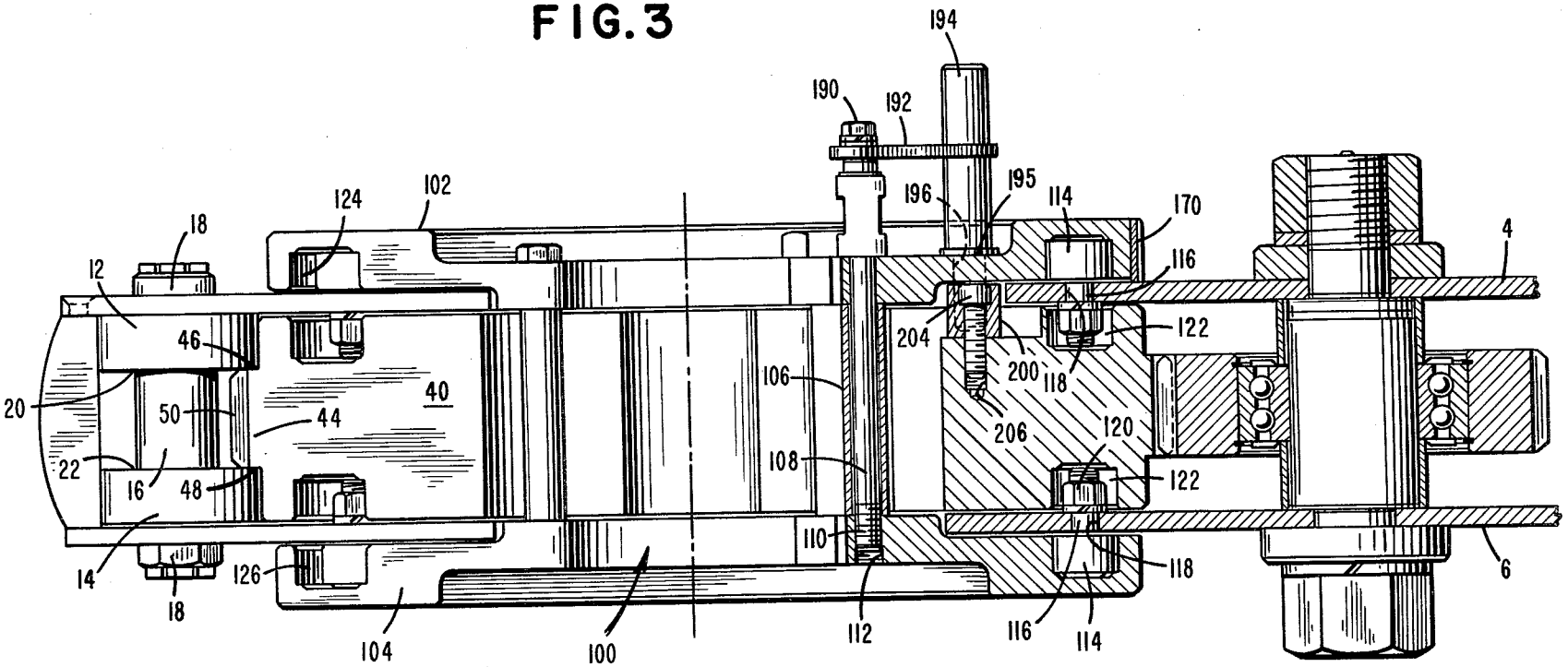
FIG. 3 is a vertical cross-section view taken along the line 3—3 in FIG. 1.

The ring 40 may be rotated relative to the frame 2 by means of drive train 60 shown in FIG. 2. The drive train 60 includes a motor drive gear 62 which engages a clutch assembly 64. More particularly, the motor drive gear 62 meshes with the clutch drive gear 66 which is rigidly attached to clutch shaft 68. The clutch assembly also includes a low speed clutch gear 70 and a high speed clutch gear 72 which can be selectively actuated by moving a shifting collar (not shown) which surrounds clutch shaft 68 by means of a conventional shifting assembly (not shown). The low and high speed clutch gears 70 and 72 mesh with low and high speed pinion gears 74 and 76, respectively. The low and high speed pinion gears 74 and 76 are carried by a sleeve 78 rotatably mounted upon a bearing post 80. The sleeve 78 includes gear teeth 82 which mesh with pinion idler gear 84. The pinion idler gear 84 in turn drives rotary idler gears 86 and 88 which mesh with the gear teeth 50 on the ring 40. The drive train is powered by a motor which has not been illustrated in the drawings. However, it will be understood that any conventional motor may be employed which is capable of rotating the motor drive gear 62 in either direction. The drive shaft of the motor fits into the keyed opening 90 of the motor drive gear.

The pipe-gripping mechanism further includes a die carrier 100 which is mounted for rotation on the tong and has an opening 101 which is adapted to align with the throat 10 of the frame and the opening 42 of the partial ring. The die carrier 100 includes upper and lower arcuate plates 102 and 104, respectively, spaced apart by spacer sleeves 106. The plates 102 and 104 are held in position by bolts 108 which have a lower threaded end portion 110 which is threaded into a threaded opening 112 in lower arcuate plate 104. The upper and lower plates 4 and 6 of the frame 2 have a plurality of guide wheels 114 rotatably mounted thereon. The guide wheels 114 are rotatably mounted on shafts 116 by means of suitable bearings. The shafts 116 extend through openings 118 in the upper and lower plates 4 and 6 and are retained by nuts 120 housed in grooves 122 in ring 40. These guide wheels 114 ride in grooves 124 and 126 defined in the lower and upper surfaces, respectively, of the upper and lower plates 102 and 104, respectively. This construction permits the partial ring 40 and the die carrier 100 to rotate relative to one another. As will be appreciated, the grooves 124 and 126 may be defined in the upper and lower surfaces of the partial ring 40 and the guide wheels 114 rotatably mounted on the die carrier 100 so that the die carrier is rotatably mounted on the partial ring rather than the frame.

Pivotally mounted to the die carrier 100 by hinge pins 130 and 132 are a pair of link members 134 and 136, respectively. The link members each include similarly shaped upper and lower arcuate wall portions. Only the upper wall portions 138 and 140 of the link members 134 and 136, respectively, are shown in the drawings. The link members also each include a cylindrically shaped side wall portion 142 and 143, respectively. Each of the link members 134 and 136 normally carries a front die 144 and 146, respectively, and a rear die 148 and 150, respectively. The dies are mounted on the side wall portions 142 and 143. Each of the link members 134 and 136 also includes head rollers 152 and 154, respectively, which are rotatably mounted by head roller pins 156 and 158, respectively, between the arcuate upper and lower wall portions and act as cam followers. The front and rear dies are typically provided with serrated faces which grip the pipe section. Although front and rear dies have been illustrated, it will be appreciated that each of the link members 134 and 136 may only carry one die with the dies mounted in opposed relationship.

The inner surfaces of the side portion of the partial ring 40 facing the throat 10 are provided with three arcuate depressions on both sides of the pipe section. These depressions are positioned adjacent the link members 134 and 136. Depressions 160 and 161 serve as a neutral cam surface for receiving the head rollers 152 and 154, respectively, when the pipe-gripping mechanism is in its initial rest position. The depressions 162 and 163 serve as cam surfaces for urging the front dies 144 and 146 into gripping engagement with the pipe section when the ring 40 is rotated in the clockwise direction. The depressions 164 and 165, in like manner, urge the front dies into gripping engagement with the pipe section when the ring 40 is rotated in the counterclockwise direction.

The cam surfaces 162, 163, 164, and 165 have a specially designed and critical "cam angle" which must be employed in order to properly engage the front and rear dies with the pipe section. More particularly, the "cam angle" must be about ½ to 5½°, and preferably 2° to 3°, with 2½° being most preferred to obtain the necessary engagement for proper pipe handling.

The "cam angle" is defined as the angle formed by lines originating at the center of rotation of the partial ring 40 and a point on a line perpendicular to the center line of the throat 10 and passing through the center of rotation and terminating at the point on the cam surface at which the cam follower is positioned when the dies are in contact with the pipe section. The "cam angle" is illustrated as "A" in FIG. 2. The angle "A" is constructed as follows using the cam surface 163 as illustrative. A point "B" on the cam surface 163 is found at which the dies 144, 146, 148, and 150 engage the pipe. This point "B" is dependent on the pipe diameter and different size link members 134 and 136 are used depending upon the pipe diameter. A line "C" is drawn between the center of rotation of the partial ring 40 and the point "B". A line "D" is then drawn between point "B" at the angle "A" from line "C" so that the line "D" intersects a line "E" which is perpendicular to the center line "F" of the throat at a point "G" which is between the center of rotation of the partial ring 40 and the neutral cam surface 161 which is adjacent point "B". The cam surface 163 and also the cam surface 165 form a portion of a circle having a center at point "G". The cam surfaces 162 and 164 are constructed in similar manner.

Referring now in more detail to the arrangement of the front and rear dies relative to the axis of rotation of the ring 40. It will be seen in FIG. 2 that a circle drawn about this axis may be divided into four quadrants by the center line "F" of the throat 10 and the line "E" passing through the axis of rotation perpendicular to the center line. The rear dies 148 and 150 are located in adjacent rear quadrants and the front dies 144 and 146 are located in adjacent front quadrants of the circle. The link members 134 and 136 are so mounted that the cam surfaces urge the front dies 144 and 146 toward the pipe in an approximately radial direction. Accordingly, the front dies serve a dual purpose, namely, they not only grip the pipe section themselves but also urge the pipe section into engagement with the rear dies 148 and 150.

Mounted to the upper plate 4 of frame 2 is an arcuate brake band 170 having flange portions 172. Bolts 174 extend through openings (not shown) in the flanges 172 and serve to attach the brake band 170 to brackets 176. The brackets 176 are welded to the upper plate 4 and the bolts 174 are retained by nuts 178. The brake band 170 partially surrounds and frictionally engages the outer periphery of the upper plate 102 of the die carrier 100. The brake band 170 is restrained against vertical movement by retainers 180 which are bolted at 182 to the upper plate 4. Spring 184 is attached to brake band 170 at the rear end to slightly tension the brake band away from the die carrier 100.

The bolt head of the rear bolt 108 is elongated to form a spacer. The top of the elongated bolt head has a threaded opening which receives the threaded end of bolt 190. Pivotally mounted on bolt 190 is a retainer plate 192 which has an opening which receives backing pin 194. Backing pin 194 has shoulder 195 which retains the backing pin in retainer plate 192. Backing pin 194 can be inserted into one of openings 196 and 198 in the upper plate 102 of die carrier 100. Openings 196 and 198 are positioned one on either side of backing lug 200 when the opening 101 in the die carrier 100 is aligned with the opening 42 in the partial ring 40. The backing lug 200 is mounted in a recess 202 in the upper surface of the partial ring 40. The backing lug 200 is retained in place by bolt 204 which is threaded into a threaded opening 206 in the partial ring 40. The backing pin 194 abuts against the backing lug 200 and causes the partial ring 40 and die carrier 100 to move in unison with their openings 42 and 101, respectively, aligned while the opening 42 in the partial ring 40 is being aligned with the throat 10 in the frame.

In operation, the opening 42 in the partial ring 40 is aligned with the throat 10 in the frame 2 so that the pipe section may be inserted into the interior of the partial ring. In inserting the pipe, the door 26 is pivoted open to allow the pipe to be placed in the throat 10 and then closed. When inserted, the exterior surface of the pipe section comes into contact with the rear dies 148 and 150 of link members 134 and 136, respectively, and the longitudinal axis of the pipe section is approximately coincident with the axis of rotation of the partial ring 40. After the pipe section is in position, power is applied by the motor (not shown) to rotate the partial ring 40 either clockwise or counterclockwise. For the purpose of illustration, it will be assumed that the partial ring 40 is rotated in a clockwise direction.

As the ring 40 begins to rotate in a clockwise direction from the position shown in FIG. 1, the die carrier 100 will remain stationary because of the frictional engagement of the die carrier 100 with the brake band 170. Therefore, the cam surfaces 162 and 163 on the partial ring 40 will move relative to the cam followers 152 and 154 on the link members 134 and 136, respectively. Upon continued rotation of the ring 40, the cam surface 162 will cause the link member 134 to pivot in a counterclockwise direction about the hinge pin 130 upon which it is mounted and, in like manner, the cam surface 163 will cause the link member 136 to pivot in a clockwise direction about its hinge pin 132. These movements of the link member 134 and 136 will bring the front dies 144 and 146 into gripping engagement with the surface of the pipe section. Because of the specially designed cam surfaces and the carefully selected "cam angle", the force exerted by the dies on the pipe is concentrated at or near the center of rotation of the pipe section. Moreover, the force is evenly distributed and controlled so that the pipe is gripped tightly enough to allow proper torque to be applied without crushing or damaging the pipe.

After the front dies 144 and 146 are brought into contact with the pipe section, further relative movement between the cam followers 152 and 154 and the cam surfaces 162 and 163 is not possible. Accordingly, the die carrier 100 will begin to rotate in unison with the ring 40. The pipe section, being tightly gripped by the front and rear dies against relative movement with respect to the die carrier, also will begin to rotate in a clockwise direction. This rotation may be continued for as many revolutions as may be required in order to make up or break apart a threaded connection between one end of the pipe section and another pipe section positioned in alignment therewith.

After the pipe section has been rotated sufficiently to make up or break apart the joint, the tong may be freed from the pipe section by rotating the ring 40 in the opposite direction, namely, in the counterclockwise direction in terms of this illustration, to position the cam followers 152 and 154 in the neutral cam surfaces 160 and 161, respectively. With the parts in this position, the front dies 144 and 146 may be disengaged from the pipe section and the tong may be moved rearwardly to free the rear dies 148 and 150 from contact with the surface of the pipe section. Thereafter, the ring 40 may be further rotated in the counterclockwise direction, if necessary, to position its opening 42 in alignment with the throat 10. The rotation of ring 40 will also cause die carrier 100 to be rotated back into its initial rest position by reason of the cooperation between backing pin 194 and backing lug 200 so that the pipe section may pass out of the tong.

As will be appreciated, the tong is also capable of rotating the pipe section in a counterclockwise direction. In order to accomplish this, the tong is operated in a manner substantially as described above, the only difference being that the partial ring 40 is rotated in the opposite direction and the cam surfaces 164 and 165 on the partial ring 40 cooperate with the cam followers 152 and 154.

It is to be understood that while one form of the invention has been illustrated, there are other forms which fall within the scope of the invention. For example, the link members which carry the dies can be mounted on the die carrier so that the link members are moved perpendicular to the center line of the throat of the partial ring at all times rather than pivotally. Accordingly, the invention is not to be limited to such specific form except as provided by the appended claims.

I claim:

1. A power tong for rotating a pipe of selected outside diameter to make up or break apart a threaded joint comprising a frame having a throat for receiving a pipe, a partial ring rotatably mounted on said frame about a center of rotation defining a first reference point and having an opening therein which is adapted to be aligned with said throat so that a pipe may be positioned within said partial ring, said partial ring defining first and second cam surfaces positioned on opposite sides of the center line of said opening, said first and second cam surfaces each including a neutral cam surface and two gripping cam surfaces, said neutral cam surface of said first and second cam surfaces being radially outwardly of said two gripping cam surfaces of said first and second cam surfaces, respectively, relative to said center line of said opening to permit said pipe to be positioned in said opening, said two gripping cam surfaces of said first and second cam surfaces forming portions of circles whose centers are at second reference points lying between said first reference point and said neutral cam surface of said first and second cam surfaces, respectively, said second reference points lying on a line which is perpendicular to the center line of said partial ring and passes through said first reference point, means for rotating said partial ring about said center of rotation, and die means operatively associated with said partial ring, said die means having a size and radius of curvature corresponding to said selected outside diameter of said pipe and including dies and cam followers positioned on opposite sides of said center line of said opening, said cam followers being received in said neutral cam surfaces when said power tong is in its neutral position so that said dies are out of gripping engagement with said pipe, said cam followers being adapted to move along said gripping cam surfaces to move said die means inwardly so that said dies grip said pipe on opposite sides thereof on rotation of said partial ring, the position of said cam followers along said gripping cam surfaces when said dies grip said pipe defining third reference points, first and second lines originating at said first and second reference points, respectively, and terminating at said third reference points relative to each of said first and second cam surfaces defining a cam angle of about ½° to 5½° whereby rotation of said partial ring causes said dies to grip said pipe at said cam angle for turning movement of said pipe to make up or break apart a threaded joint.

2. The power tong of claim 1 in which said cam angle is about 2° to 3°.

3. The power tong of claim 1 in which said cam angle is about 2½°.

4. The power tong of claim 1 in which said center line of said opening of said partial ring and said line perpendicular thereto which passes through said center of rotation of said partial ring divide a circle about said center of rotation of said partial ring into four quadrants, said neutral cam surfaces being positioned on said perpendicular line, said die means include an arcuate die carrier rotatably mounted on said tong and a first and second pair of dies, said first pair of dies being mounted on said die carrier and positioned in the two of said four quadrants opposite said opening in said partial ring, said second pair of dies being mounted on said die carrier for movement in generally radial directions and being positioned in the two quadrants adjacent said opening in said partial ring, said cam followers cooperating with said first and second pairs of dies and being positioned relatively close to said neutral cam surfaces when said dies engage said pipe.

5. The power tong of claim 1 in which said die means include a die carrier mounted on said tong for rotation relative to said partial ring, a pair of link means pivotally connected to said die carrier and each being associated with one of said cam followers, said link means being pivoted to move portions thereof closer to the center of rotation of said partial ring upon rotation of said partial ring, said die means further include a first and second pair of dies, said first pair of dies being mounted on said link means in position to engage a pipe positioned within said partial ring, said second pair of dies being mounted on said link means in position to press against the surface of the pipe to urge said pipe toward said first pair of dies.

6. The power tong of claim 1 in which said frame includes upper and lower members spaced from each other and terminating at said throat, first guide rollers means mounted on said lower member, second guide rollers means mounted on said upper member, said partial ring includes a portion mounted within said frame adapted to be guided by said first and second guide roller means, first gear means being fixed to said partial ring, and a drive train including second gear means engaging a portion of the periphery of said first gear means for rotating said partial ring relative to said frame.

7. A power tong for rotating a pipe of selected outside diameter to make up or break apart a threaded joint comprising a frame having a throat for receiving a pipe, a partial ring rotatably mounted on said frame about a center of rotation defining a first reference point and having an opening therein which is adapted to be aligned with said throat so that a pipe may be positioned within said partial ring, said partial ring defining first and second cam surfaces positioned on opposite sides of the center line of said opening, said first and second cam surfaces each including two gripping cam surfaces, said two gripping cam surfaces of said first and second cam surfaces forming portions of circles whose centers are at second reference points lying between said first reference point and said first and second cam surfaces, respectively, said second reference points lying on a line which is perpendicular to the center line of said partial ring and passes through said first reference point, means for rotating said partial ring about said center of rotation, and die means operatively associated with said partial ring, said die means having a size and radius of curvature corresponding to said selected outside diameter of said pipe and including dies and cam followers positioned on opposite sides of said center line of said opening, said cam followers being adapted to move along said gripping cam surfaces to move said die means inwardly so that said dies grip said pipe on opposite sides thereof on rotation of said partial ring, the position of said cam followers along said gripping cam surfaces when said dies grip said pipe defining third reference points, first and second lines originating at said first and second reference points, respectively, and terminating at said third reference points relative to each of said first and second cam surfaces defining a cam angle of about ½° to 5½° whereby rotation of said partial ring causes said dies to grip said pipe at said cam angle for turning movement of said pipe to make up or break apart a threaded joint.

8. The power tong of claim 7 in which said cam angle is about 2° to 3°.

9. The power tong of claim 7 in which said cam angle is about 2½°.

* * * * *